US005433152A

United States Patent [19]

Henry

[11] Patent Number: 5,433,152

[45] Date of Patent: Jul. 18, 1995

[54] SHELF SUPPORTED ON A TOWEL BAR

[76] Inventor: William R. Henry, 2 Country Club Rd., Unit #24, Cocoa Beach, Fla. 32931

[21] Appl. No.: 149,514

[22] Filed: Nov. 9, 1993

[51] Int. Cl.[6] ..... A47B 23/00

[52] U.S. Cl. ..... 108/42; 211/90; 248/214

[58] Field of Search ..... 108/42; 211/88, 90; 241/602; 312/138.1, 228, 77.1; 206/77.1; 248/214

[56] References Cited

U.S. PATENT DOCUMENTS

| | | | |
|---|---|---|---|
| 1,102,060 | 6/1914 | Leach | 312/348.1 X |
| 1,983,527 | 12/1934 | Bennet | 241/602 X |
| 4,799,432 | 1/1989 | Rickner | 108/42 |
| 4,827,849 | 5/1989 | Vignale | 108/42 X |
| 4,870,907 | 10/1989 | McKee | 108/42 |
| 5,257,423 | 11/1993 | Jacobsen et al. | 312/228 X |

FOREIGN PATENT DOCUMENTS

| | | | |
|---|---|---|---|
| 1580482 | 9/1969 | France | 108/42 |
| 2131394 | 6/1984 | United Kingdom | 241/602 |

*Primary Examiner*—Jose V. Chen

[57] ABSTRACT

A shelf for mounting on the towel bar and the like, comprising a tray positionable in a horizontal orientation to constitute an upper surface for supporting toilet objects, a pair of depending support plates extending downwardly from the lower surface of the tray with upwardly directed recesses positionable on a towel rack, and vertically extending supports depending downwardly from the rear edge of the tray with an adhesive on their exposed rearwardly facing surfaces for coupling to a wall between the ends of the towel rack.

5 Claims, 4 Drawing Sheets

FIG 3
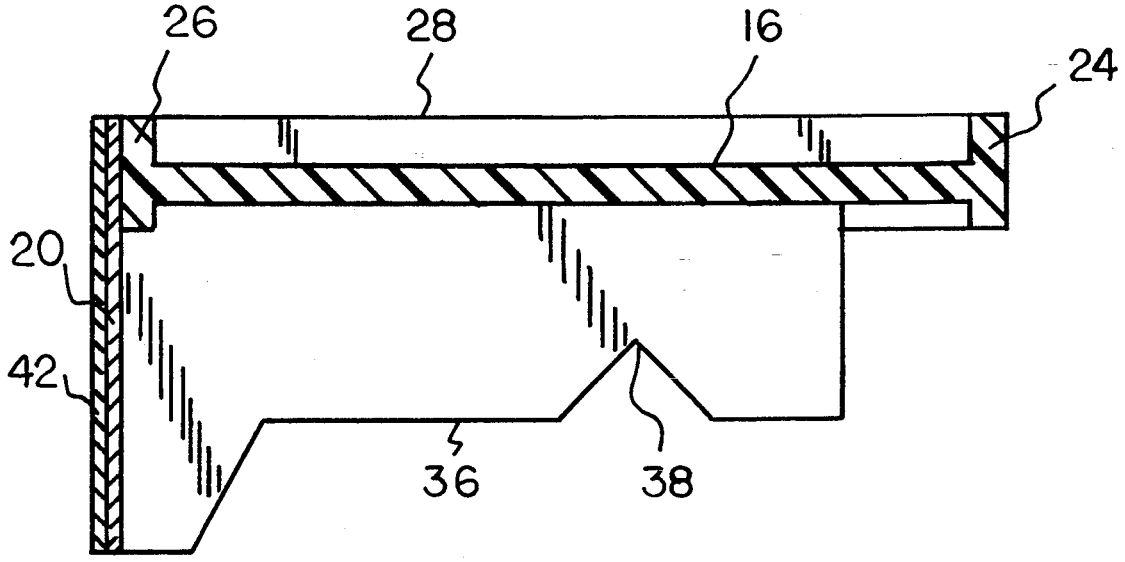
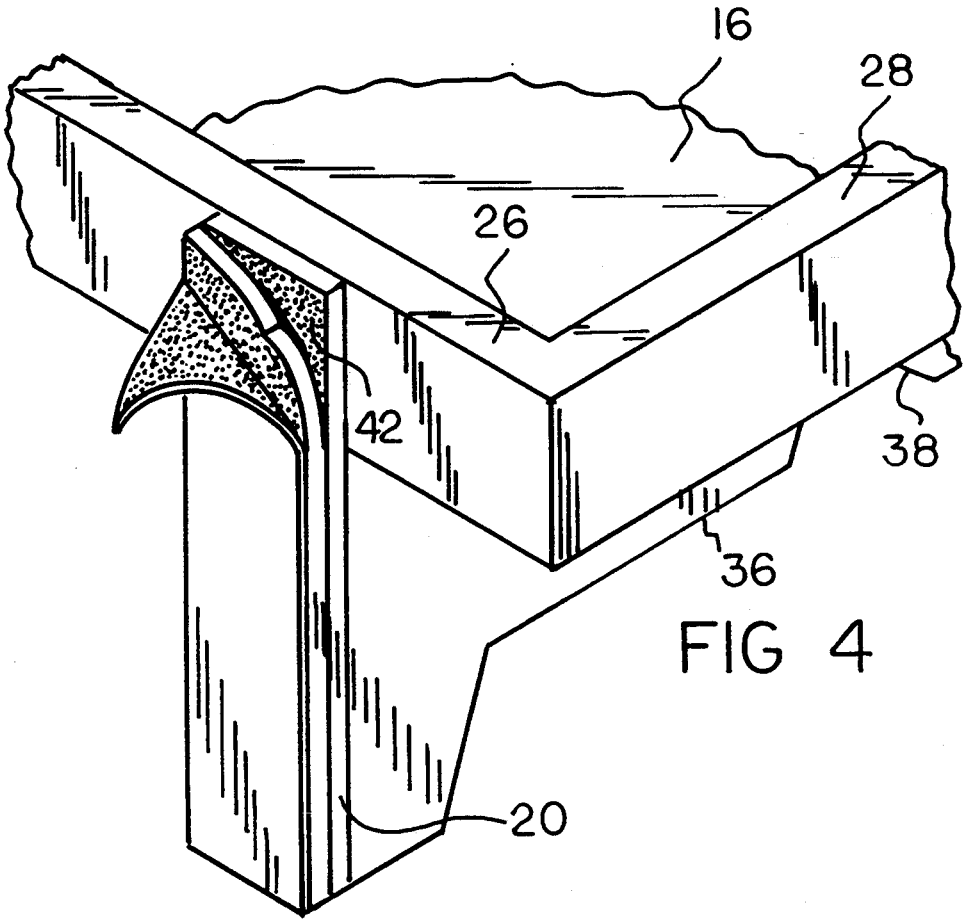
FIG 4

SHELF SUPPORTED ON A TOWEL BAR

BACKGROUND OF THE INVENTION

1. Field of the Invention

The present invention relates to a shelf supported on a towel bar and more particularly pertains to a shelf which may be supported on a towel bar of a bathroom or the like.

2. Description of the Prior Art

The use of shelves is known in the prior art. More specifically, shelves heretofore devised and utilized for the purpose of supporting articles are known to consist basically of familiar, expected and obvious structural configurations, notwithstanding the myriad of designs encompassed by the crowded prior art which have been developed for the fulfillment of countless objectives and requirements.

The prior art discloses a large number of shelves supported on a towel bar. By way of example, U.S. Pat. Nos. 4,827,849 to Vignale and 4,870,907 to McKee disclose shelves with a single planar surface.

U.S. Pat. Nos. 4,181,382 to Harvey and 4,799,432 to Rickner disclose plural shelves supported by a common towel rack.

U.S. Pat. No. 3,233,744 to Ripps discloses a shelf with apertures in its support surface supported on a towel rack.

In this respect, the shelf supported on a towel bar according to the present invention substantially departs from the conventional concepts and designs of the prior art, and in so doing provides an apparatus primarily developed for the purpose of supporting toiletry articles on a shelf supported by a towel bar of a bathroom or the like.

Therefore, it can be appreciated that there exists a continuing need for new and improved shelves for supporting toiletry articles which can be easily and conveniently supported by an existing apparatus. In this regard, the present invention substantially fulfills this need.

SUMMARY OF THE INVENTION

In view of the foregoing disadvantages inherent in the known types of shelves supported on a towel bar now present in the prior art, the present invention provides an improved shelf supported on a towel bar construction wherein the same can be utilized for supporting toiletry articles and the like. As such, the general purpose of the present invention, which will be described subsequently in greater detail, is to provide new and improved shelves supported on a towel bar apparatus and method which has all the advantages of the prior art shelves and none of the disadvantages.

To attain this, the present invention essentially comprises a shelf for mounting on the towel bar of a bath room and the like, comprising, in combination, a rectangular tray having long parallel front and rear edges and short end edges and positionable in horizontal orientation with upstanding side walls formed integrally therewith to constitute an upper surface for supporting toilet objects, a pair of depending support plates extending downwardly from the lower surface of the tray with upwardly directed recesses positionable on a towel rack, vertically extending supports depending downwardly from the rear edge of the tray with an adhesive on their exposed rearwardly facing surfaces for coupling to a wall between the ends of the towel rack, a lotion dispenser centrally located on the upper surface of the tray with an associated dispensing tube extending through the lower surface of the container to exterior of the device and a spring mounted button to effect discharge of the liquid from within the container, and a transparent spray shield pivotally mounted to the top of the tray to maintain the objects of the tray dry.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shelf supported on a towel bar which has all the advantages of the prior art shelves supported on a towel bars and none of the disadvantages.

It is another object of the present invention to provide a new and improved shelf supported on a towel bar which may be easily and efficiently manufactured and marketed.

It is a further object of the present invention to provide a new and improved shelf supported on a towel bar which is of a durable and reliable construction.

An even further object of the present invention is to provide a new and improved shelf supported on a towel bar which is susceptible of a low cost of manufacture with regard to both materials and labor, and which accordingly is then susceptible of low prices of sale to the consuming public, thereby making such shelves economically available to the buying public.

Still yet another object of the present invention is to provide a new and improved shelf supported on a towel bar which provides in the apparatuses and methods of the prior art some of the advantages thereof, while simultaneously overcoming some of the disadvantages normally associated therewith.

Still another object of the present invention is to provide a new and improved shelf for mounting on the towel bar and the like, comprising a tray positionable in a horizontal orientation to constitute an upper surface for supporting toilet objects a pair of depending support plates extending downwardly from the lower surface of the tray with upwardly directed recesses positionable on a towel rack; and vertically extending supports depending downwardly from the rear edge of the tray with an adhesive on their exposed rearwardly facing surfaces for coupling to a wall between the ends of the towel rack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a sectional view of the shelf supported on a towel bar of the prior Figures taken along line 3—3 of FIG. 2.

FIG. 4 is a rear perspective of an upper end portion of the shelf supported on a towel bar of the prior Figures.

DESCRIPTION OF THE PREFERRED EMBODIMENT

Figure 1:
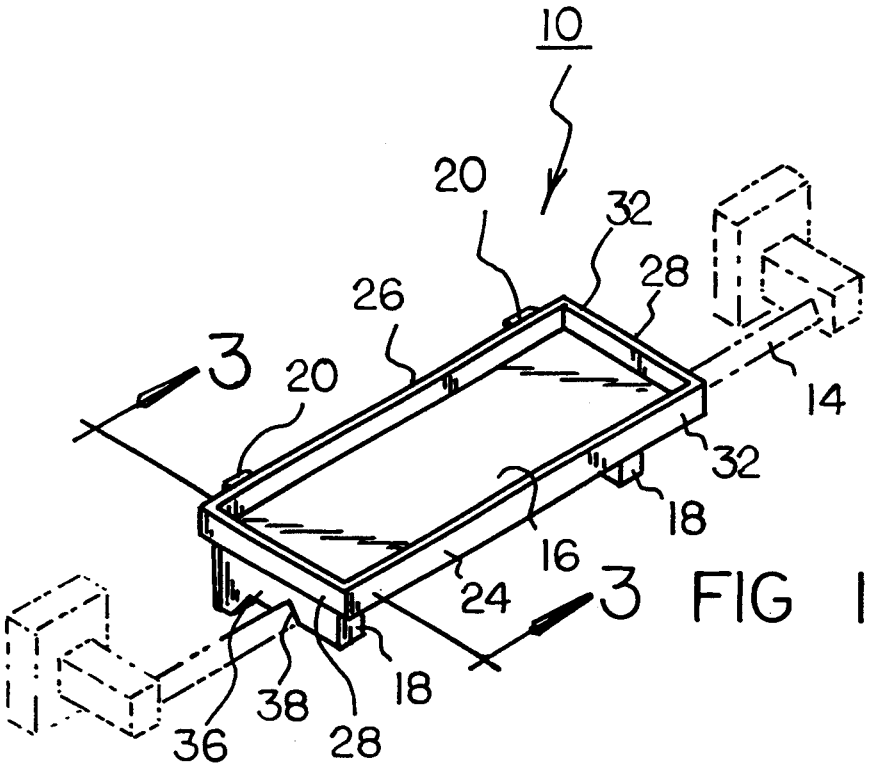
FIG. 1 is a perspective view of the shelf supported on a towel bar constructed in accordance with the principles of the present invention.
Figure 2:
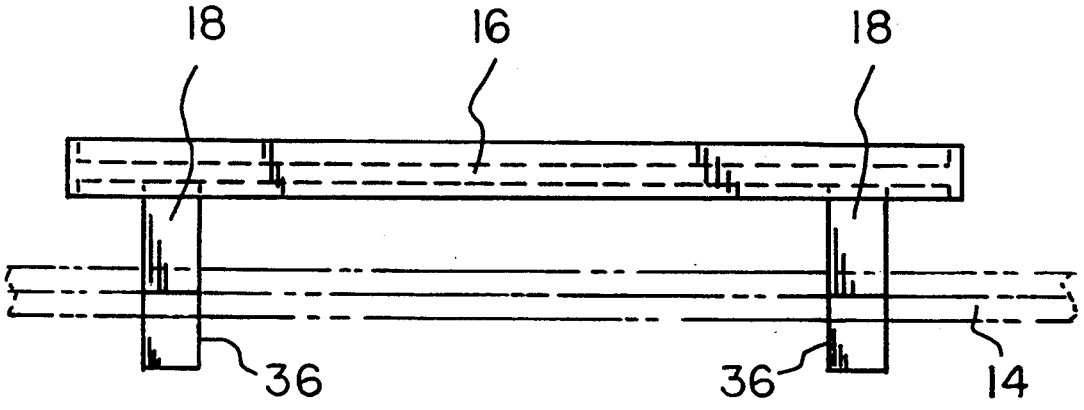
FIG. 2 is a front elevational view of the shelf supported on a towel bar as shown in FIG. 1.

With reference now to the drawings, and in particular to FIG. 1 thereof, a new and improved xx embodying the principles and concepts of the present invention and generally designated by the reference numeral 10 will be described.

Finding a suitable place to store shampoo, shaving cream, conditioner, and other items that are often used when showering is becoming much more difficult. This is because a lot of homes built recently have shower stalls instead of bathtubs, particularly in the master bedroom. A bathtub has the capability of holding all these items, and still has plenty of room left over. However, the same cannot be said for a shower stall.

The present invention is a unique device that fits on a towel bar in a shower stall. Its primary function is to hold containers of shampoo, rinses, soap, conditioners, etc. The back of the present invention, which rests up against the wall or tile, has a self-adhesive piece of shim stock. This helps to secure it to the wall so that it does not fall off the towel bar. The bottom has a special groove or notch cut into it. The groove is designed specifically to rest on the towel bar, and to increase its stability.

Presently, the only purpose of the conventional towel bar is to provide a place on which to hang a towel. The problem is that the towel gets soaked long before the person is finished showering. Thus, a towel bar which is located in a shower is really a fixture that is totally useless. The present invention has taken this negative situation, and turned it into something positive.

The present invention is made from plastic, and is extremely durable. Installation is a simple procedure that takes very little time and requires virtually no tools. This is a quality product that is easy to use and is virtually maintenance-free.

The present invention relates to a shelf 10 for mounting on the towel bar 14 of the type normally found in a bathroom. The shelf includes a plurality of main components including a tray 16, depending support plates 18, rear supports 20 and other optional components.

More specifically, the tray 16 is formed with long parallel front and rear edges 24 and 26. Coupled therebetween are short end edges 28. The tray is positionable in a horizontal orientation and preferably includes upstanding side walls 32 formed integrally with the tray. Together the side walls and tray constitute an upper support surface for supporting toilet objects normally associated with a bathroom and bathing.

The next major component of the shelf is a pair of depending support plates 36. The support plates depend downwardly from the lower surface of the tray 16 parallel with each other and parallel with the end edges 28. Each of the support plates includes an upwardly directed recess 38 in a V-shaped configuration. The V-shaped recess is positionable on the rail of the towel bar 12 for physical support during operation and use.

Positioned on the rear edge of the tray are downwardly depending supports 20. The supports 20 are provided on their rear surface with an adhesive 42 for the coupling to the adjacent wall of the bathroom at a location between the ends of the towel bar. Any type of appropriate adhesive could be utilized including a tape of double faced adhesive with a removable non-adhesive cover layer thereon. Note FIG. 4.

Figure 5:
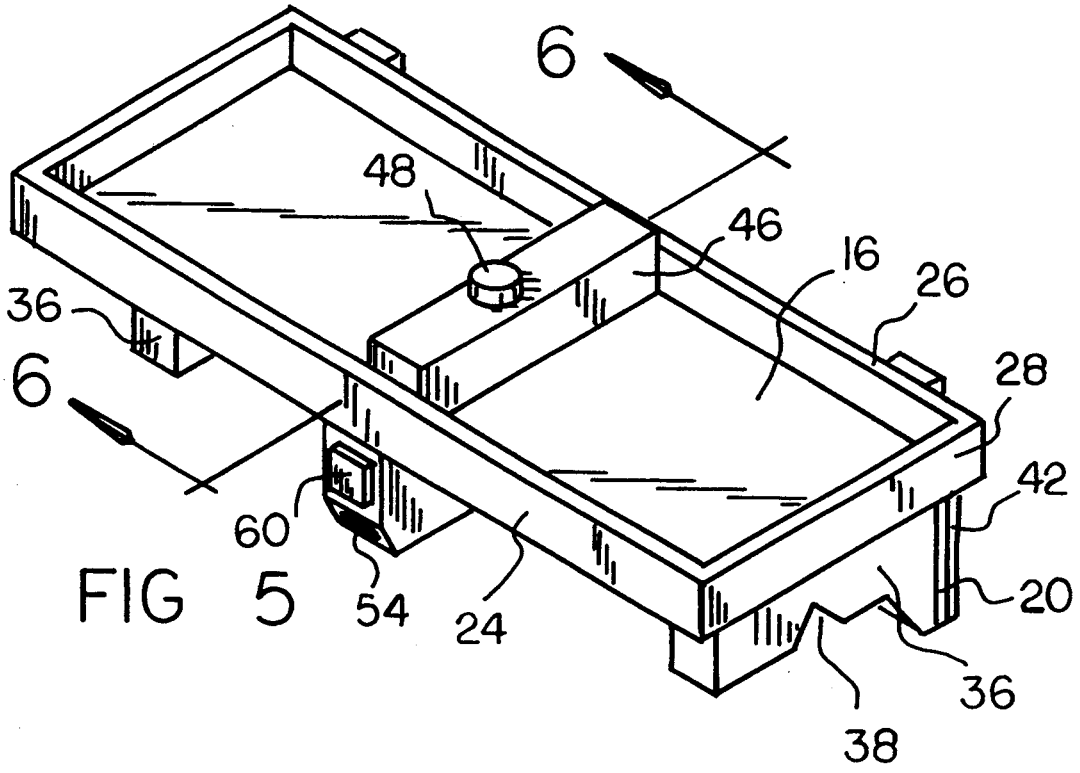
FIG. 5 is a perspective view of a shelf supported on a towel bar constructed in accordance with an alternate embodiment of the invention.
Figure 6:
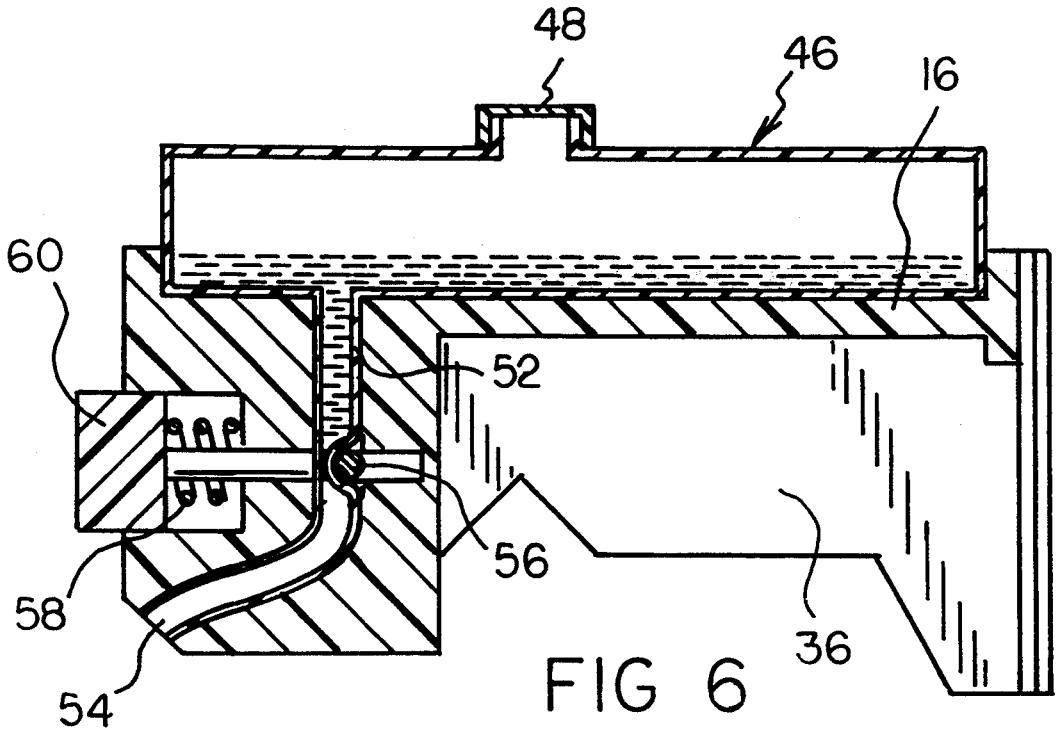
FIG. 6 is a sectional view of the shelf supported on a towel bar of the prior Figure taken along line 6—6 of FIG. 5.

An optional component of the shelf is shown in FIGS. 5 and 6. Such optional component is a lotion dispenser 46. The container is a sealed chamber with an opening at its upper end for filling the container with soap, shampoo or other fluid associated with showering or bathing. A cap 48 is positioned over the opening. Located in a lower extent of the dispenser is an opening with a tube 52. The tube 52 is flexible at least in a central extent thereof and extends downwardly to an opening 54. At a central extent of the tube, a pincer bar 56 is urged by a spring 58 to seal the tube and preclude dispensing of fluids form the dispenser container. An associated button 60 operable by a user is adapted to be depressed to move the pincer finger 56 away from the tube and allow dispensing of the fluid from the container under the force of gravity. The entire lotion dispenser is preferably located in a central extent of the shelf thereby dividing the shelf into two smaller shelves on the opposite sides thereof.

Figure 7:
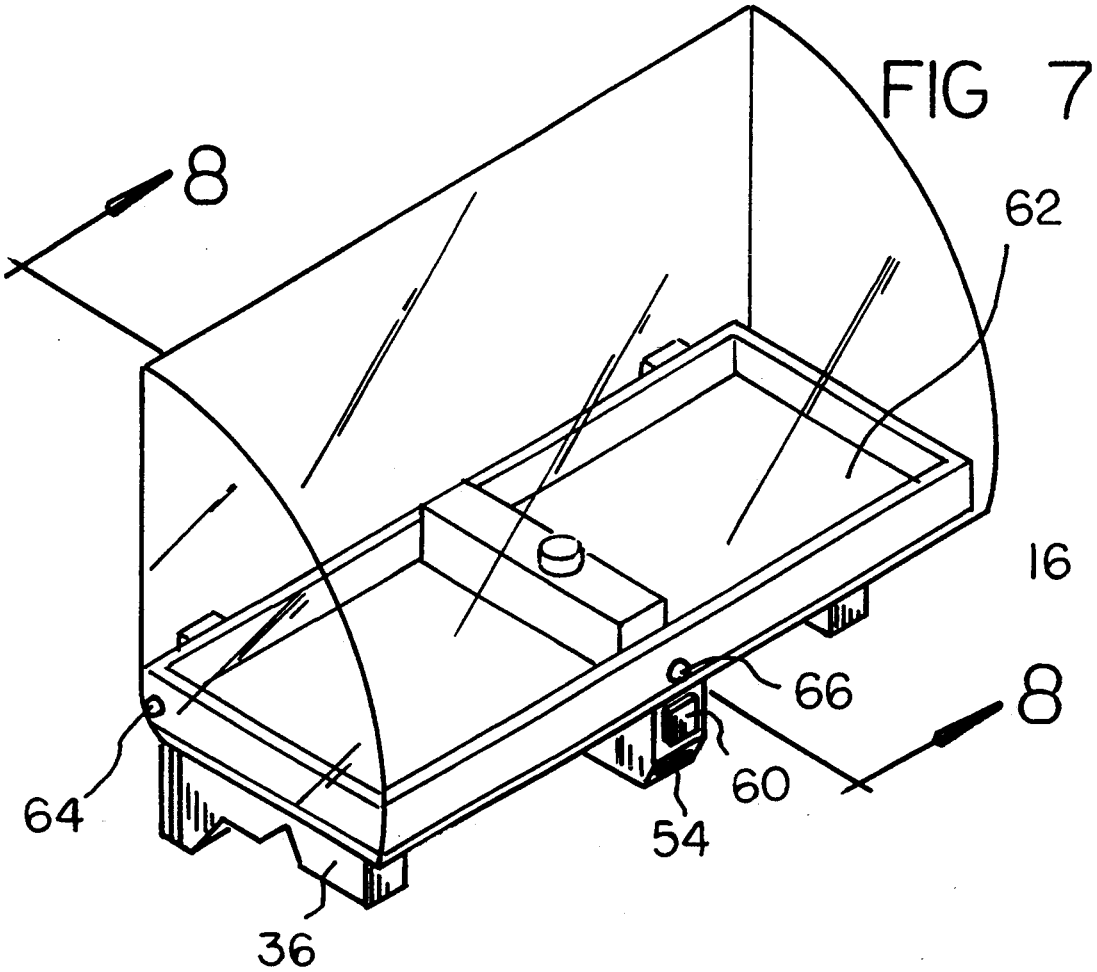
FIG. 7 is a perspective view of a shelf supported on a towel bar constructed in accordance with another alternate embodiment of the invention.
Figure 8:
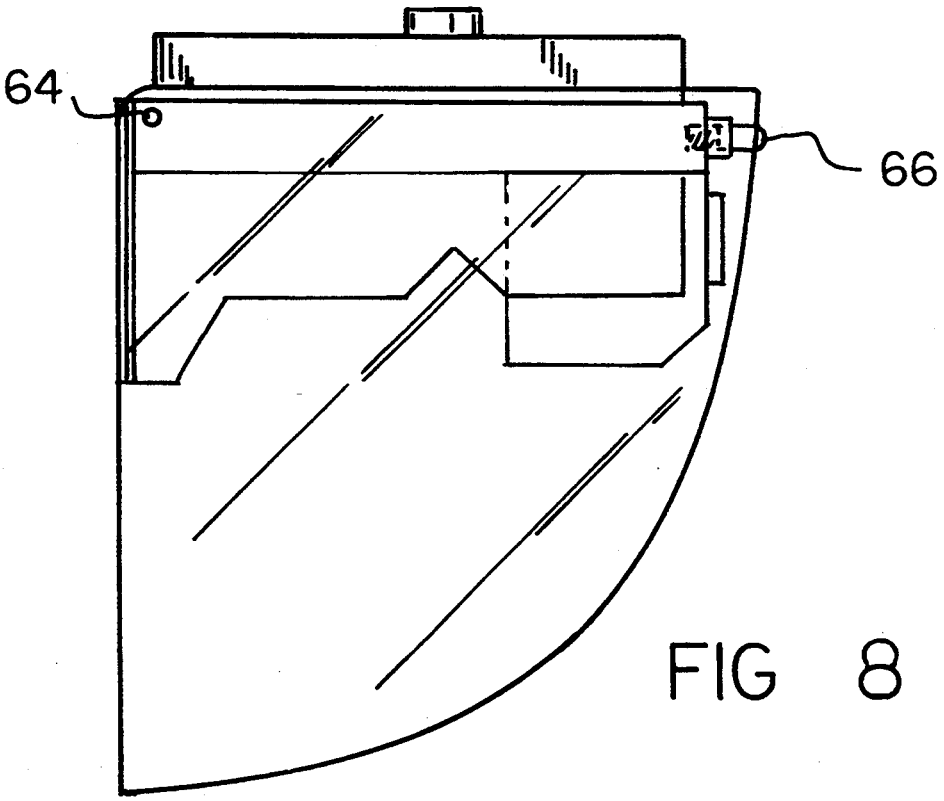
FIG. 8 is a sectional view of the shelf supported on a towel bar of the prior Figure taken along line 8—8 of FIG. 7.

A last feature of the invention is illustrated in FIGS. 7 and 8. Such last feature is a spray shield 62. The spray shield is coupled to the shelf by means of pivot pins 64. It is held in position over the contents of the shelf by means of a spring bias pin 66. Depression of the buttons 66 allows the shield to pivot downwardly about pins 64 to the lower position as shown in FIG. 8 for putting things on the shelf or taking them off. On the shelf is pivoted about pins 64 and raised to the closed position of FIG. 7, the contents of the shelf will not become wet by being sprayed from the shower, bath or other inadvertent water in the room in which the shelf is utilized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shelf for mounting on the towel bar of a bathroom and the like, comprising, in combination:

a rectangular tray having long parallel front and rear edges and short end edges and positionable in horizontal orientation with upstanding side walls formed integrally therewith to constitute an upper surface for supporting toilet objects;

a pair of depending support plates having a top end and a bottom end extending downwardly from the lower surface of the tray including upwardly directed recesses at said bottom end positionable on a towel rack;

vertically extending supports depending downwardly from the rear edge and top end of the tray, to said bottom end each in contact at its upper end with the tray and at its lower end with one of said support plates and with an adhesive on their exposed rearwardly facing surfaces for coupling to a wall between the ends of the towel rack;

a lotion dispenser centrally located on the upper surface of the tray with an associated dispensing tube extending through the lower surface of the container to exterior thereof and a spring mounted button to effect discharge of the liquid from within the container; and a transparent spray shield pivotally mounted to the top of the tray to maintain the objects of the tray dry.

2. A shelf for mounting on the towel bar and the like, comprising:

a tray positionable in horizontal orientation to constitute an upper surface for supporting toilet objects;

a pair of depending support plates having a top end and a bottom end extending downwardly from the lower surface of the tray with upwardly directed recesses at said bottom end positionable on a towel rack; and vertically extending supports depending downwardly from the rear edge and top end of the tray, each in contact at its upper end with the tray to said bottom end and at its lower end with one of said support plates with an adhesive on their exposed rearwardly facing surfaces for coupling to a wall between the ends of the towel rack.

3. The apparatus as set forth in claim 2 and further including:

a lotion dispenser centrally located on the upper surface of the tray with an associated dispensing tube extending through the lower surface of the container to exterior thereof and a spring mounted button to effect discharge of the liquid from within the container.

4. The apparatus as set forth in claim 2 and further including:

a transparent spray shield pivotally mounted to the top of the tray to maintain the objects of the tray dry.

5. The apparatus as set forth in claim 2 wherein the top of each support is coextensive with the top of the shelf and the bottom of each support extends beneath the recesses.

* * * * *